US005558198A

United States Patent [19]

Juarez

[11] Patent Number: 5,558,198

[45] Date of Patent: Sep. 24, 1996

[54] BAND TRANSPORTATION SYSTEM

[76] Inventor: Ramiro O. Juarez, Espana 282, Cochabamba, Bolivia

[21] Appl. No.: 529,885

[22] Filed: Sep. 18, 1995

[51] Int. Cl.[6] ..... B66B 29/08

[52] U.S. Cl. ..... 198/324; 104/20; 104/25

[58] Field of Search ..... 198/321, 324; 104/20, 21, 25

[56] References Cited

U.S. PATENT DOCUMENTS

| | | | |
|---|---|---|---|
| 1,665,483 | 4/1928 | Taylor . | |
| 3,265,010 | 8/1966 | Makiri . | |
| 3,421,450 | 1/1969 | Bell | 104/25 |
| 3,757,420 | 9/1973 | Silverman | 198/321 X |
| 3,934,515 | 1/1976 | Cushman | 104/25 X |
| 4,828,099 | 5/1989 | Dexter, Jr. | 198/324 |
| 4,964,496 | 10/1990 | Dexter, Jr. | 198/324 |

*Primary Examiner*—D. Glenn Dayoan
*Attorney, Agent, or Firm*—J. Sanchelima

[57] ABSTRACT

A band transportation system that includes a main band that extends over a closed path and includes one or more straight portions, an embarking band assembly and a disembarking band assembly with straight portions each that are brought adjacent to the straight portion of the main band by hydraulic mechanisms that move a carousel on which the embarking and disembarking bands are mounted. When the embarking and/or disembarking bands reach the speed of the main band, the passenger move from one band to the other when they are traveling on the straight portion which has sufficient length to permit this. The main band is electrically powered and the embarking and disembarking bands may include electromagnetic levitating mechanisms. Dividers are positioned on the different bands to protect the passengers from the wind. An alternate embodiment includes the use of an intermediate band assembly that travels at a constant speed equal to the speed of the main band.

20 Claims, 3 Drawing Sheets

BAND TRANSPORTATION SYSTEM

BACKGROUND OF THE INVENTION

1. Field of the Invention

The present invention relates to a continuous band transportation system for passengers and/or goods using belts, and more particularly, to the type employing several bands at different speeds to facilitate the acceleration and deceleration of passengers and goods.

2. Description of the Related Art

Applicant believes that the closest references correspond to U.S. Pat. No. 3,265,010 issued to U. Makiri in 1966 for a mass transportation system. Makiri's patent discloses a mass transportation system having a plurality of parallel bands continuously moving adjacent to each other. Each band runs the entire path making it very expensive. This is true for the transportation system disclosed in U.S. Pat. No. 1,665,483 issued to H. E. Taylor in 1926. The bands in Taylor also require to operate at different speeds requiring the passengers to move through adjacent bands. These two patented inventions also differ from the present invention in that they do not disclose the boarding mechanism as claimed here. Makiris's and Taylor's patents do not suggest the characteristics claimed in the present invention, as set forth below. Here, the boarding and existing mechanisms involve only one band that is brought to the speed of the main band.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a new and improved boarding and disembarking system employing a movable band that accelerates and decelerates it to match the speed of the main band.

It is another object of this invention to provide a continuous boarding and disembarking system that minimizes wasted time of passengers in contrast with the conventional public transportation system.

It is still another object of this invention to provide a comfortable and safe boarding system by seating the passengers.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
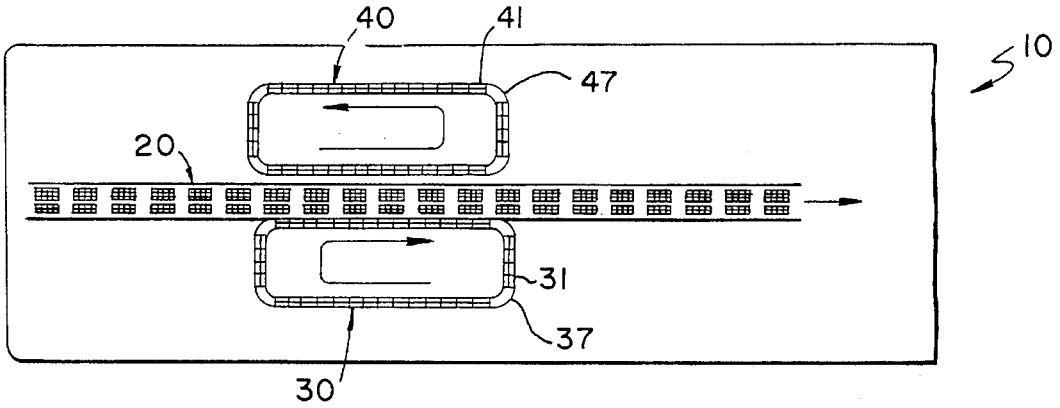
FIG. 1 is a schematic representation of the transportation system subject of the present application.

Referring now to the drawings, where the present invention is generally referred to with numeral 10, it can be observed that it basically includes transporting main band assembly 20, boarding passenger band assembly 30 and disembarking passenger band assembly 40, as shown in FIG. 1.

Figure 2:
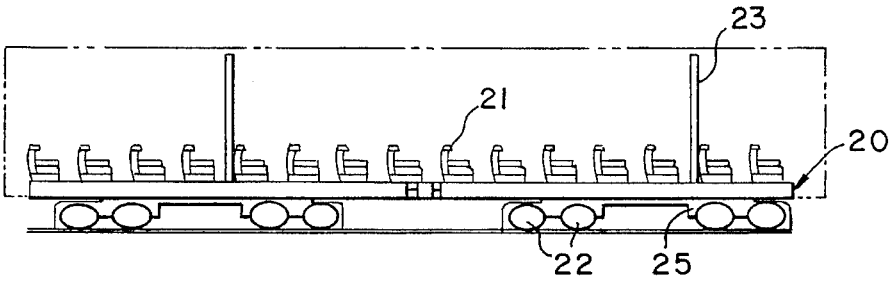
FIG. 2 is an elevational lateral view of the main band assembly.
Figure 3:
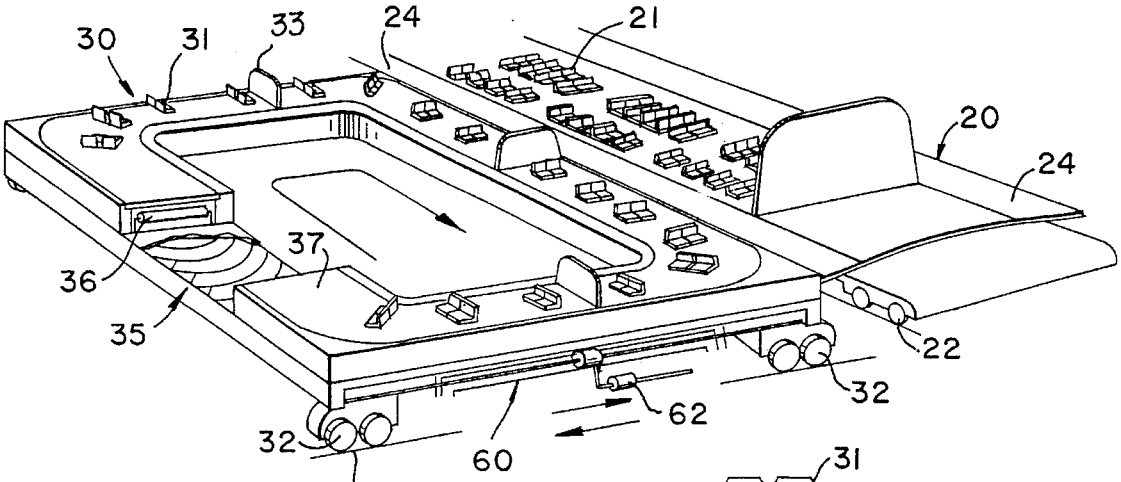
FIG. 3 shows an isometric view of the boarding passenger band assembly, with a partial cross-section of the magnetic acceleration mechanism.

In FIG. 2, an elevational lateral view of main band assembly 20 shows seats 21, wheels 22 and dividers 23. Main band 20 extends along a closed path having at least one straight portion for boarding and disembarking passengers. Passengers sit on seats 21 and are protected from the wind by dividers 23. In the preferred embodiment, main band 20 is propelled preferably by using electric motor traction. Electric motor 25 is powered by electrical current supplied like most subways. In the preferred embodiment, main transporting band assembly 20 is accelerated to about 60 Km/hour. Main band assembly 20 includes two lateral aisles 24 that permit passengers to walk from one band to another in the instant of couplement, as best seen in FIG. 3.

Figure 4:
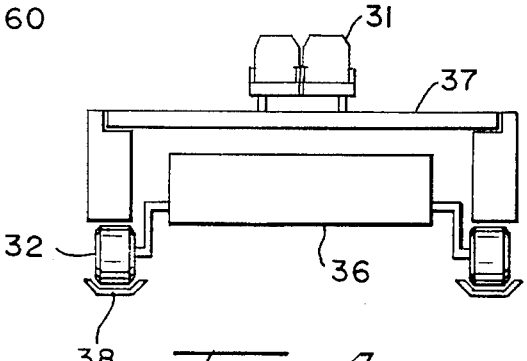
FIG. 4 is a representation of a cross-sectional view of boarding passenger band assembly.

Boarding passenger band assembly 30 extends over a closed path and includes a straight portion that runs parallel to a portion of main band assembly 20. Band member 37 is accelerated by levitating electromagnetic accelerator mechanism 36, shown in FIG. 4. Passengers sit on seat assemblies 31 that are mounted on boarding band 37 and are partially protected from the formed air stream by separator 33. Boarding passenger assembly 30, in the preferred embodiment, starts at rest and increases its speeds to match the speed of main band assembly 20. Once the speed is matched the passengers walk from band assembly 30 to main band assembly 20.

Disembarking passenger band assembly 40, in the preferred embodiment, operates under the same principle as boarding passenger band assembly 30, but in reverse. When a passenger desires to get out at a certain station, he or she changes from seats 21 in main band 20 to seats 41 in disembarking band 47 of mechanism 40.

The passengers move from boarding passenger assembly 30 to main band assembly 20 where the straight parallel portions are. These straight portions are brought close to each other by hydraulic cylinder assembly 60. The same is true for disembarking and the passengers move from main band 20 to disembarking band assembly 40 also at portions that are parallel to each other. These straight portions need to be long enough to give the passengers sufficient time to accomplish this. Approximately between ten or twenty seconds are enough for passengers to walk from assembly 30 to band 20, or from band 20 to assembly 40. For this time these straight parallel portions need to be between 140 and 280 meters for a speed of 60 Km/h.

Boarding and disembarking assemblies 30 and 40 are mounted on moving carousels 35 and 45 (not shown), respectively, as shown in FIG. 3. Double action hydraulic cylinder assembly 60 is used to move carousels 35 and 45 by hydraulic pump 62. Carousels 35 and 45 move towards and away from main band 20 also helped by wheels 32 which travel on rails 38.

In fact, a more continuous flow of passengers can be achieved with several band assemblies 30 and 40 cooperatively positioned on the straight portions of the path of main band 20. Preferably, at each straight portion there are two boarding assemblies 30 so that one is in close proximity to band 20 and the other mechanism 130 is at rest loading. This assumes faster access to main band assembly 20. Otherwise, passengers would have to wait too long. Obviously, if three or more boarding assemblies are used, the waiting time is further reduced. Conversely, for disembarking assembly 40 we have the same situation. It is also possible to use the same mechanism of assembly 30 or 40 for both, embarking and disembarking.

Figure 5:
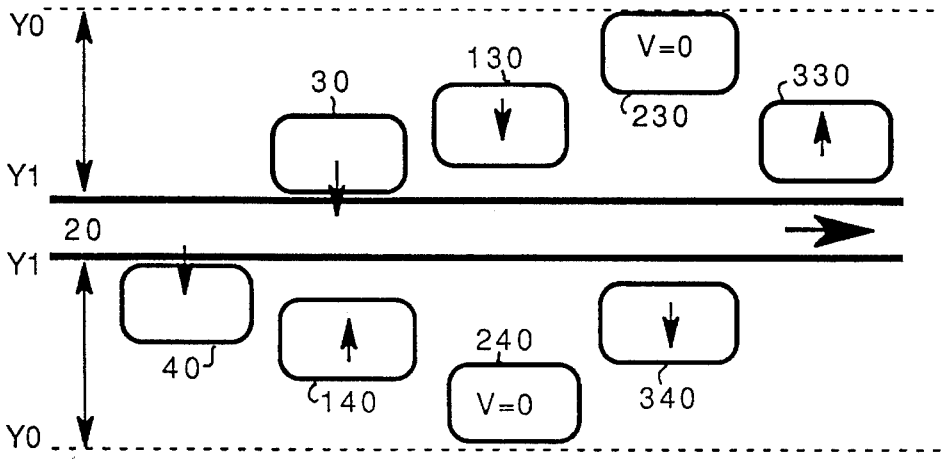
FIG. 5 is a representation of a station using four boarding band assemblies and four disembarking band assemblies, in relation to the main band.
Figure 6:
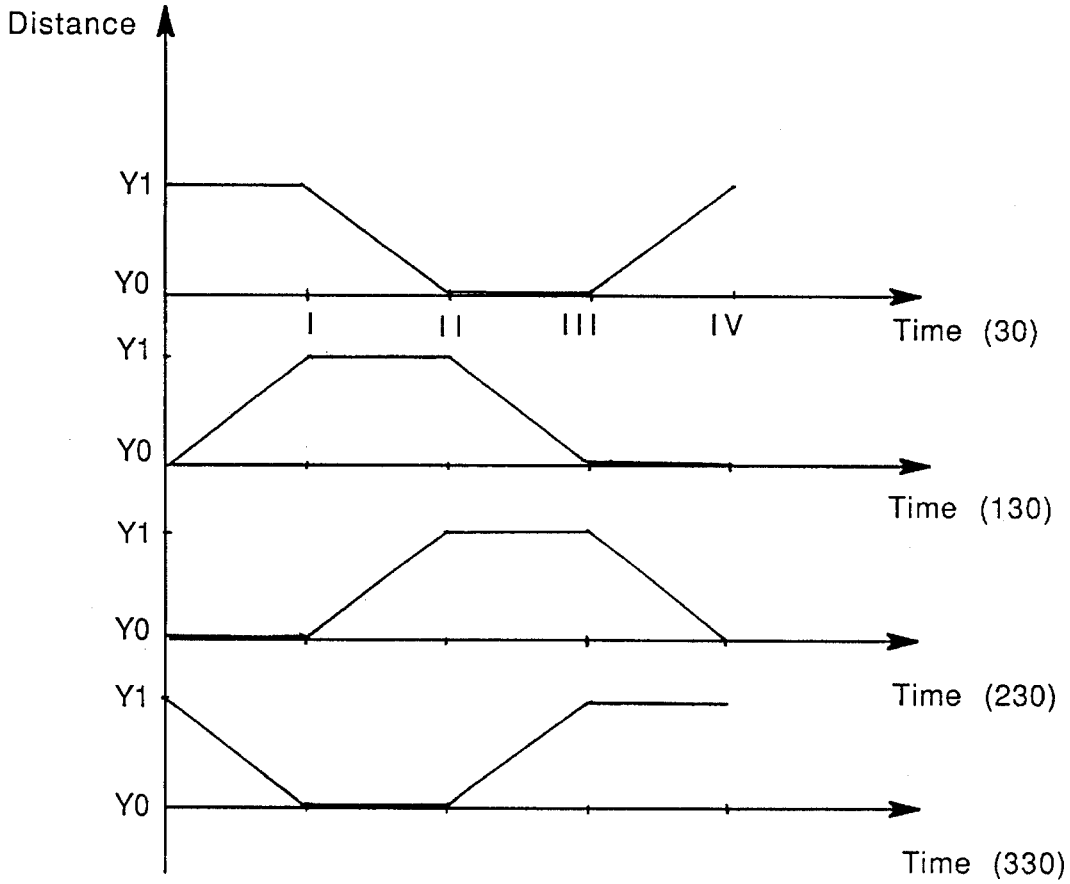
FIG. 6 is a graphic representation of one cycle of the movement of the boarding mechanisms or disembarking mechanisms for an alternate embodiment illustrated in FIG. 5.

In the embodiment shown in FIG. 5, there are four boarding assemblies 30; 130; 230 and 330, and four disembarking assemblies 40; 140; 240 and 340 at the same station. When mechanism 30 is arriving at close proximity to band 20, assembly 130 is leaving (and starting to decelerate) band 20 and assembly 230 is at rest (after loading passengers) and about to start accelerating, and assembly 330 is moving towards band assembly 20. The same principle is applied to disembarking assemblies 40; 140; 240 and 340. In this manner, passengers riding main band 20 will always have an opportunity to disembark through either disembarking assemblies 40; 140; 249 or 340. Passengers that cannot disembark through disembarking assembly 40, have a chance to use assembly 140, or a few seconds afterwards band assembly 240, or after that band assembly 340. The movement cycles for assemblies 30; 130; 230 and 330 with respect to assemblies and 40; 140; 240 and 340, respectively, should be 180° out of phases, as best seen in FIG. 5. In other words, when assembly 30 is approaching, disembarking assembly 40 is leaving band 20. This permits passengers to leave main band 20 without interfering passengers boarding band 20. In FIG. 6 one cycle of the movement of embarking assemblies 30; 130; 230 and 330 are shown. A similar graphic may be envisioned for assemblies 40; 140; 240 and 340. When assembly 30 is close to main band 20 (quarter I of the cycle and at a distance marked with Y1), the horizontal straight line shows the approximate time needed for the passengers to move from band 20 to assembly 30. During the same time period, assembly 130 is accelerating and moving towards band 20, while assembly 230 is at rest boarding new passengers (at a distance marked with Y0) and assembly 330 is decelerating and separating from band 20. The next time period (quarter II) corresponds to the deceleration of assembly 30 while assembly is adjacent to band 20 at a constant speed (that matches the speed of band 20), assembly 230 is accelerating and separating from band 20, and assembly 330 is at rest away from band 20. In this manner, at every quarter of a cycle there is a boarding assembly close to band 20 boarding the passengers.

Figure 7:
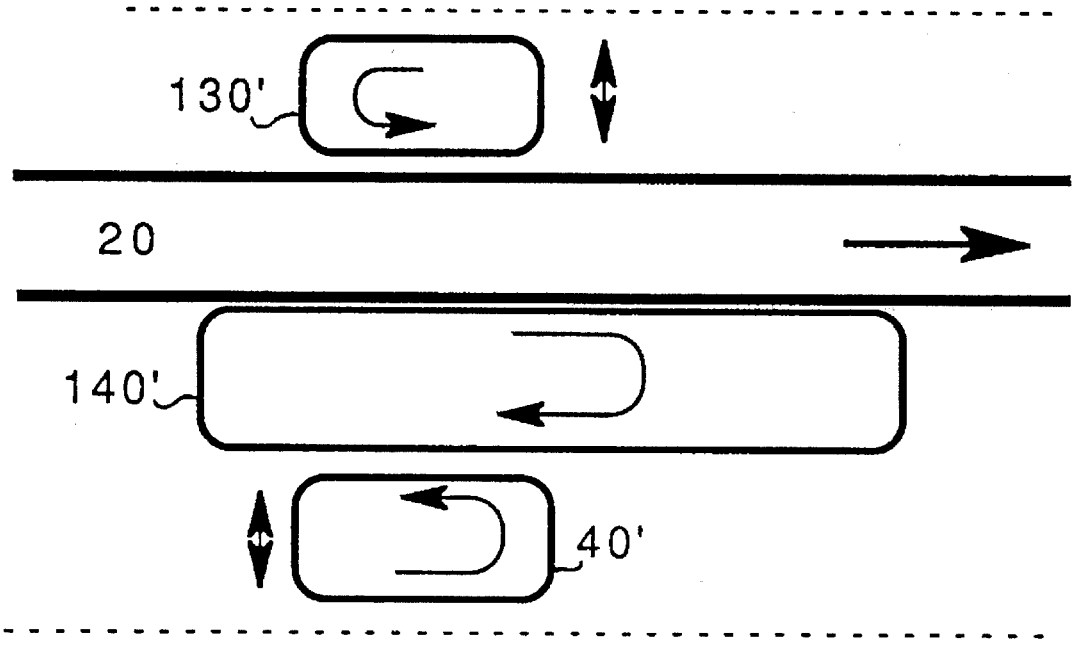
FIG. 7 is a representation of another alternative for the disembarking mechanism having an intermediate band.

Another alternate embodiment is shown in FIG. 7, wherein there is an intermediate band 140' that travels at a constant speed that matches the speed of band 20. Disembarking assembly 40' works generally in the manner described above and passengers pass from main band 20 to intermediate band assembly 140'. Passengers subsequently pass to disembarking band assembly 40'. Band assembly 40' separates from band 20 and decelerates to rest for disembarking passengers. In this manner, passengers will always have an opportunity to disembark at a given station even if they have to say on intermediate band 140' until assembly 40' approaches it. Band assembly 140' does not require seats because passengers are there temporarily. Handles are sufficient. This is not a problem for embarking passengers because they will always have access to main band 20. Embarking band assembly 130' works like the previously described assembly 30.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A band transportation system, comprising:

a) first transporting band means extending along a closed path and including mounted on said first band means, and said first band means further including first propelling means for accelerating said first band means to a predetermined speed, and said first band means having at least one straight portion;

b) second transporting band means extending along a closed path and including a plurality of seat assemblies for passengers mounted on said second band means, and said second band means further including second propelling means for accelerating said second band means to at least said predetermined speed of said first band means, and said second band means having at least one straight portion; and c) means for moving said second transporting band means towards and away from said first band means so that said straight portion of said first and second band means are brought sufficiently close to each other when the speed of said first and second band means is substantially the same to permit passengers to move to and from said first and second band means.

2. The band transportation system set forth in claim 1 further including:

d) third transporting band means extending along a closed path and including seat assemblies for passengers mounted on said third band means, and said third band means further including third propelling means for accelerating said third band means to at least said predetermined speed of said first band means, and said third band means having at least one Straight portion; and e) means for moving said third band means towards and away from said first band means so that said straight portion of said third band means is brought sufficiently close to the straight portion of said first band means at the side opposite to the straight portion of said second band means when the speed of said third band means is substantially the same as the speed of said first band means to permit said passengers to move to and from said first and third band means.

3. The band transportation system set forth in claim 2, further including a plurality of second transporting band means positioned adjacent to each other and to said straight portion of said first transporting band means.

4. The band transportation system set forth in claim 3 wherein said plurality of second transporting band means are designed to approach said straight portion at different times.

5. The band transportation system set forth in claim 4 wherein said means for moving said second transporting band means includes each carousel means that are hydraulically operated.

6. The band transportation system set forth in claim 5, wherein said first, second and third band means includes divider means for protecting the passengers from the wind.

7. The band transportation system set forth in claim 6 wherein the propelling means for said first band means is electrically powered.

8. The band transportation system set forth in claim 7 wherein the propelling means for said second and third transporting band means include electromagnetic levitation means.

9. The band transportation system set forth in claim 8, further including a plurality of third transporting band means positioned adjacent to each other and to said straight portion of said first transporting band means.

10. The band transportation system set forth in claim 9 wherein said plurality of third transporting band means are designed to approach said straight portion at different times.

11. The band transportation system set forth in claim 10 wherein said means for moving said second transporting band means includes each carousel means that are hydraulically operated.

12. The band transportation system set forth in claim 11, wherein said first, second and third band means includes divider means for protecting the passengers from the wind.

13. The band transportation system set forth in claim 12 wherein the propelling means for said first band means is electrically powered.

14. The band transportation system set forth in claim 13 wherein the propelling means for said second and third transporting band means include electromagnetic levitation means.

15. A band transportation system, comprising:

a) first transporting band means extending along a closed path and including a plurality of seat assemblies for passengers mounted on said first band means, and said first band means further including first propelling means for accelerating said first band means to a predetermined speed, and said first band means having at least one straight portion;

b) intermediate transporting band means extending along a closed path and traveling at constant speed that matches the speed of said first band means and said intermediate transporting band means including first and second straight portions and said first straight portion is adjacent to the straight portion of said first transporting means and said second straight portion being disposed in parallel relationship to the straight portion of said second transporting band means;

c) second transporting band means extending along a closed path and including a plurality of seat assemblies for passengers mounted on said second band means, and said second band means further including second propelling means for accelerating said second band means to at least said predetermined speed of said intermediate transporting band means, and said second band means having at least one straight portion; and d) means for moving said second transporting band means towards and away from said intermediate transporting band means so that said straight portion of said intermediate and second band means are brought sufficiently close to each other when the speed of said intermediate and second band means is substantially the same to permit passengers to move to and from said intermediate and second band transporting means.

16. The band transportation system set forth in claim 15 further including:

e) third transporting band means extending along a closed path and including a plurality of seat assemblies for passengers mounted on said third transporting band means, and said third transporting band means further including third propelling means for accelerating said third transporting band means to at least said predetermined speed of said first band means, and said third band means having at least one straight portion; and f) means for moving said third transporting band means towards and away from said first band means so that said straight portion of said third band means is brought sufficiently close to the straight portion of said first band means at the side opposite to the straight portion of said intermediate transporting band means when the speed of said third transporting band means is substantially the same as the speed of said first band means to permit said passengers to move to and from said first and third band means.

17. The band transportation system set forth in claim 16 wherein said means for moving said second and third transporting bands means includes each carousel means that are hydraulically operated.

18. The band transportation system set forth in claim 17, wherein said first, second and third band means includes divider means for protecting the passengers from the wind.

19. The band transportation system set forth in claim 18 wherein the propelling means for said first: band means is electrically powered.

20. The band transportation system set forth in claim 19 wherein the propelling means for said second and third transporting band means include electromagnetic levitation means.

* * * * *